US006510585B2

(12) United States Patent
Kalman et al.

(10) Patent No.: US 6,510,585 B2
(45) Date of Patent: Jan. 28, 2003

(54) TURBO TOOL

(75) Inventors: Jeffrey M. Kalman, Cleveland Heights, OH (US); Craig M. Saunders, Rocky River, OH (US); David Di Nunzio, Mentor, OH (US); Michael A. Seifried, Euclid, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/759,722

(22) Filed: Jan. 12, 2001

(65) Prior Publication Data

US 2001/0054214 A1 Dec. 27, 2001

Related U.S. Application Data

(60) Provisional application No. 60/176,122, filed on Jan. 14, 2000.

(51) Int. Cl.[7] ..... A47L 9/04
(52) U.S. Cl. ..... 15/387; 15/410
(58) Field of Search ..... 15/387, 410

(56) References Cited

U.S. PATENT DOCUMENTS

| | | | | |
|---|---|---|---|---|
| 1,858,043 A | | 5/1932 | Glass | |
| 2,000,930 A | | 5/1935 | De Nagy | |
| 2,881,466 A | * | 4/1959 | Bramhall | 15/375 |
| 3,167,260 A | | 1/1965 | Gibbons et al. | |
| 3,688,329 A | * | 9/1972 | Vincent et al. | 15/53.2 |
| 3,908,220 A | | 9/1975 | Adamson et al. | |
| 4,397,060 A | * | 8/1983 | Jinkins et al. | 15/377 |
| 4,589,161 A | | 5/1986 | Kochte et al. | |
| 4,733,532 A | | 3/1988 | Prahl et al. | |
| 5,088,149 A | * | 2/1992 | Berg et al. | 15/321 |
| 5,333,994 A | | 8/1994 | Doty et al. | |
| 5,345,650 A | * | 9/1994 | Downham et al. | 15/331 |
| 5,802,666 A | * | 9/1998 | Jung | 15/387 |
| 5,867,864 A | | 2/1999 | Miller et al. | |
| 6,134,746 A | | 10/2000 | Miller et al. | |

FOREIGN PATENT DOCUMENTS

GB 2 105 413 A 3/1983

* cited by examiner

*Primary Examiner*—Chris K. Moore
(74) *Attorney, Agent, or Firm*—Fay, Sharpe, Fagan, Minnich & McKee, LLP

(57) ABSTRACT

A turbo tool includes a housing forming a hollow section. The housing includes at least one air inlet and a nozzle opening spaced from the air inlet, a brushroll rotatably mounted in the housing and within the nozzle opening and a turbine. The turbine is drivingly connected to the brushroll for rotating the brushroll. The turbine is driven by a first airflow through the air inlet. A rotational axis of the brushroll is parallel to a longitudinal axis of the turbine and parallel to a longitudinal axis of the housing. A first conduit is located in the housing and connected to the nozzle opening. A second airflow occurs through the first conduit. A second conduit is fluidly connected to the first conduit and to a third conduit. The first and second airflows merge into the second conduit. A swivel attachment is connected to the third conduit and swivels the housing between two positions approximately 180 degrees apart and is locked into one of the two positions.

26 Claims, 7 Drawing Sheets

TURBO TOOL

This application claims priority from provisional application Ser. No. 60/176,122 filed on Jan. 14, 2000.

BACKGROUND OF THE INVENTION

The present invention relates to an auxiliary tool for vacuum cleaners. More particularly, the present invention relates to a turbine driven brushing tool which is attached to a separate vacuum suctioning unit and is used to suction dirt and debris from carpets, floors, and above-floor surfaces.

Air is drawn into the turbo tool to drive a turbine contained in the tool. By adding a system of gear reductions, the rotational motion of the turbine is used to drive a rotating brush. There are typically several gears and/or belts between the turbine and the brush. The end result is often a brushroll that spins much slower than the turbine.

Turbine driven brushing tools have become extremely popular for cleaning a variety of surfaces in homes, offices, or wherever there are hard-to-reach places. These tools are relatively light weight and are attached to a separate suctioning unit, such as a vacuum cleaner, to provide air suction to the tool. As will be appreciated, such tools are utilized typically for small clean-up jobs or hard-to-reach places.

There are several prior art dry turbo tools that are available. Most of these prior art turbo tools do not provide for a separate clean air inlet channel to a turbine. Rather, suction air is used to power the turbine. As a result, drawback of the known dry turbo tools is that they draw the dirt and debris directly through the turbine, thus potentially damaging the turbine.

Another drawback with the prior art dry turbo tools is that they can only be used in one orientation; that is, the tool head cannot be rotated 180° between two orientations.

Yet another drawback of prior art dry turbo tools is that they do not provide staggered air channels that guide air directly into a turbine.

Accordingly, it is desirable to develop a new and improved dry turbo tool which would overcome the foregoing deficiencies and others while meeting the above-stated needs and providing better and more advantageous overall results.

SUMMARY OF THE INVENTION

The present invention relates to a turbo tool. More particularly, the present invention relates to a dry turbo tool which is attached to a vacuum suctioning unit and is used to suction dirt and debris from carpets, floors, and above-floor surfaces.

In one embodiment, the dry turbo tool comprises a main housing with a first portion and a second portion. A brushroll housing is located within the main housing. The brushroll housing includes a top section and a bottom section. The brushroll housing houses a rotatable brushroll. The bottom section includes a suction opening through which dirt and debris are suctioned into the turbo tool.

A turbine assembly within the housing comprises a rotor, a pair of spiraled inlet channels, and an exit channel. Inlets on the housing first and second portions provide airflow to the turbine. The turbine is drivingly connected to the brushroll by a gear train which is housed within a gear train housing.

Dirty air and debris are suctioned into the turbo tool through the opening in the brushroll housing bottom section. The air passes to a tube which is connected to the suction opening in the brushroll housing top section. The tube is also connected to a tributary tube which communicates with an exhaust tube. The airflow from the brushroll housing opening and the airflow from the turbine merge into the exhaust tube through the tributary tube.

The exhaust tube connects to a hose swivel attachment which swivels between two positions approximately 180 degrees apart and locks into either position. A button is provided which serves to lock the tool into position and to allow the tool to rotate when the button is depressed.

Benefits and advantages of the invention will become apparent to those skilled in the art upon a reading and understanding of the following detailed description.

BRIEF DESCRIPTION OF THE DRAWINGS

The invention may take physical form in certain parts and arrangements of parts, one embodiment of which will be described in detail in this specification and illustrated in the accompanying drawings which form a part hereof, and wherein.

DETAILED DESCRIPTION OF AN EMBODIMENT

Figure 1:
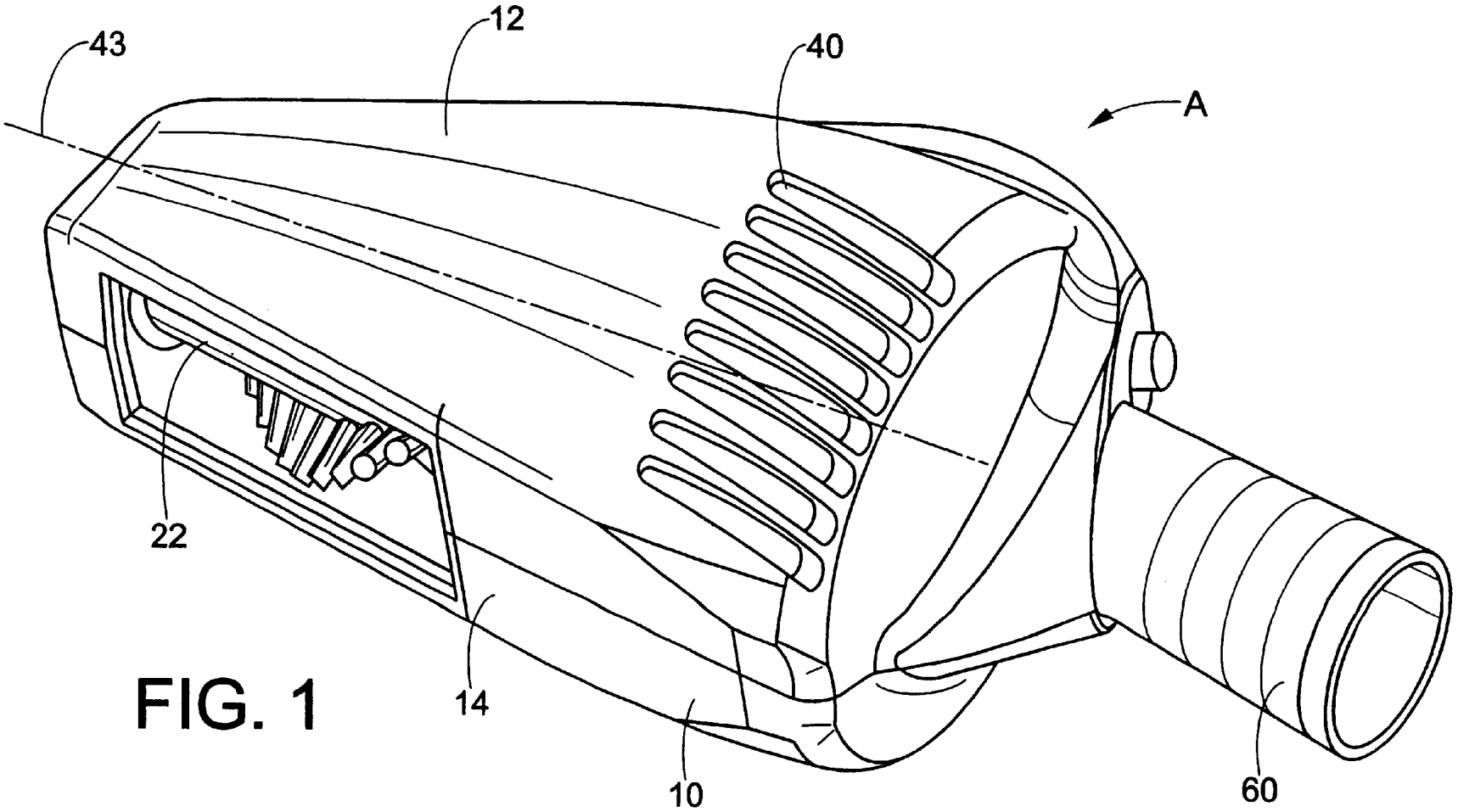
FIG. 1 is a perspective view of a turbo tool in accordance with one embodiment of the present invention.

Referring now to the drawings wherein the showings are for the purposes of illustrating the preferred embodiment of the invention only and not for purposes of limiting same, FIG. 1 shows a turbo tool A according to one embodiment of the present invention.

Figure 2:
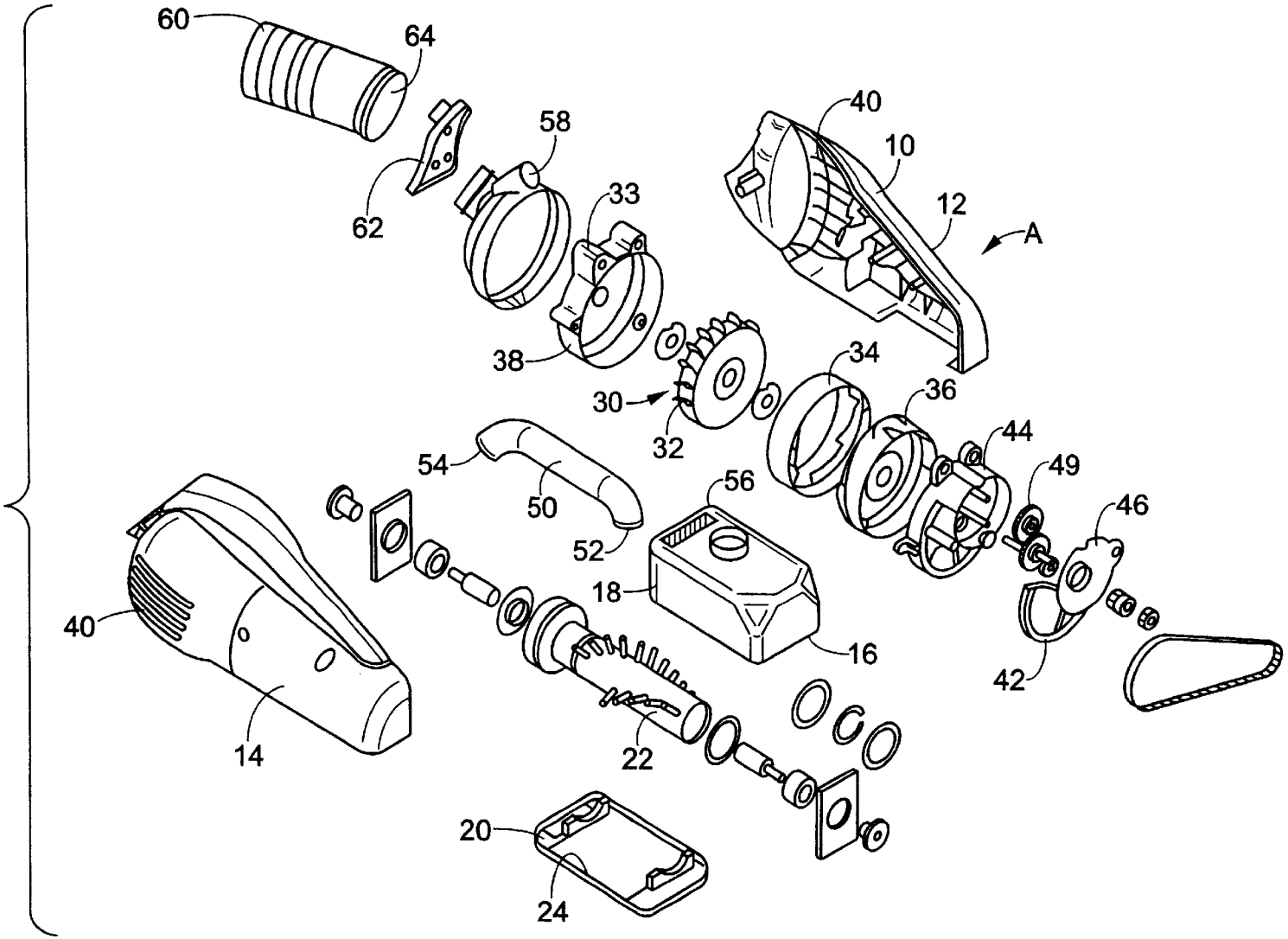
FIG. 2 is an exploded perspective view of the turbo tool of FIG. 1.
Figure 4:
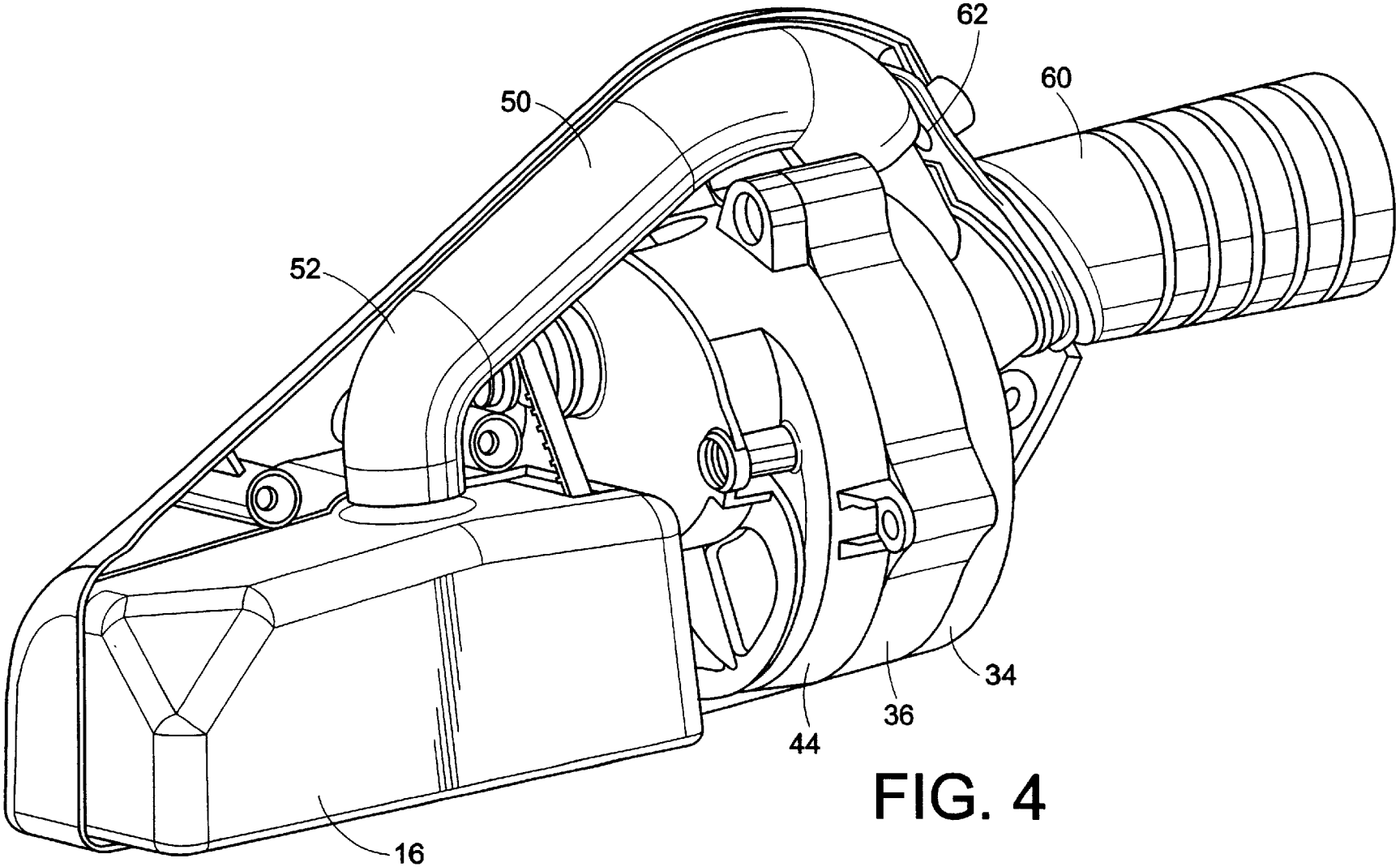
FIG. 4 is a perspective view in partial cross section of the turbo tool illustrating a brushroll housing and spiraled inlet channel within the tool.

The turbo tool A includes a main housing 10 which has a first portion 12 and a second portion 14. The first and second portions are secured to each other by suitable fasteners (not illustrated) to form a hollow section. The housing 10 may be fabricated from a thermoplastic material. Referring to FIGS. 2 and 4, a brushroll housing 16 is located within the housing 10. The brushroll housing 16 includes a top section 18 and a bottom section 20 which are secured together by a suitable fastening means (not shown). The brushroll housing 16 also may be fabricated from a thermoplastic material. The brushroll housing 16 houses a rotatable brushroll 22.

The bottom section 20 of the brushroll housing includes an opening 24 through which dirt and debris is suctioned into the turbo tool. The opening 24 in the brushroll housing acts as a suction nozzle of the turbo tool. The brushroll 22 is located within opening 24 and substantially covers the length of the opening to aid in loosening dirt and debris for being extracted from the surface being cleaned.

Figure 5:
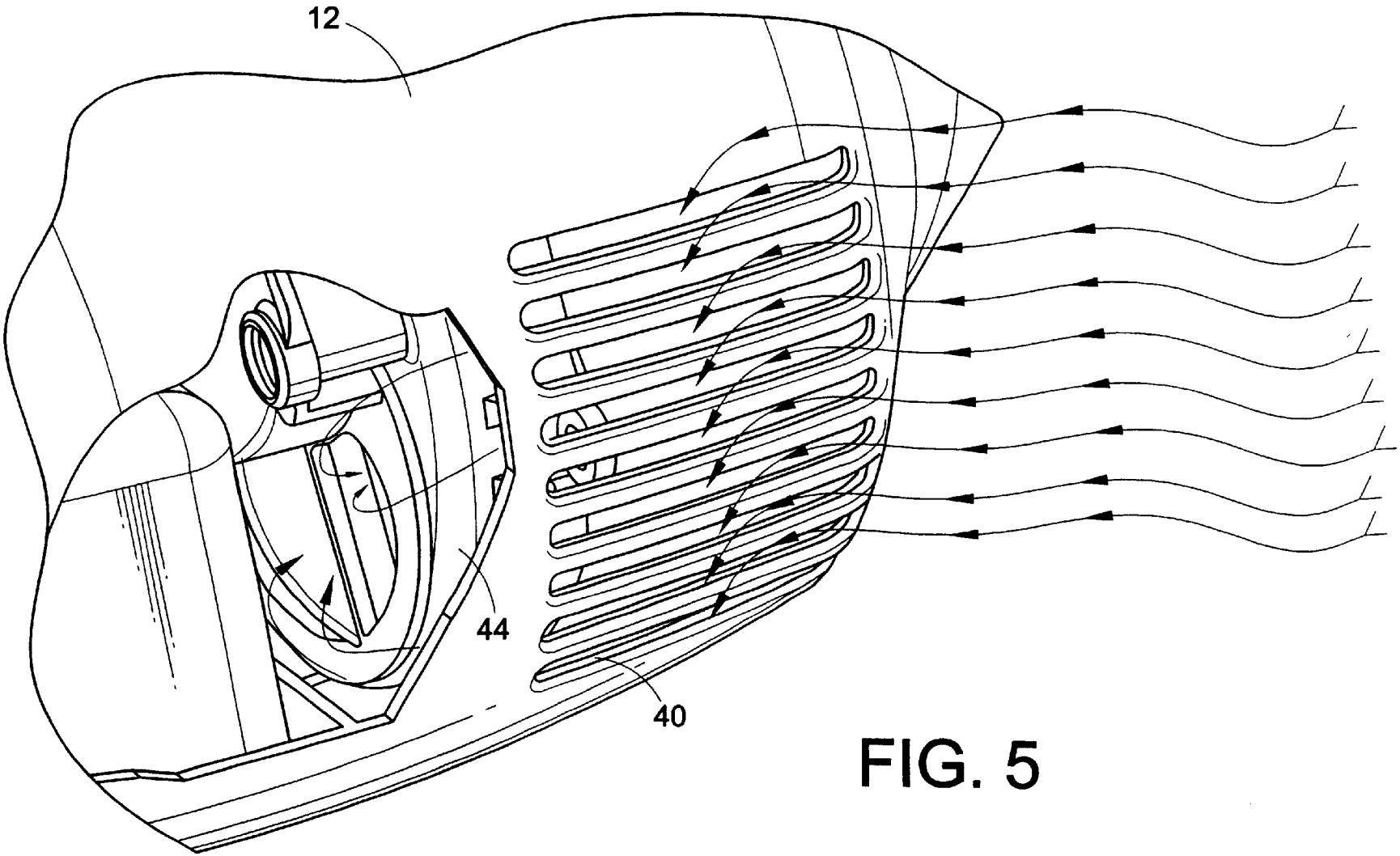
FIG. 5 is an enlarged partial perspective view of air inlet channels of the turbo tool housing illustrating airflow through the channels.

The turbo tool further includes a turbine assembly 30 held within the main housing 10. The turbine assembly 30 comprises a turbine rotor 32 mounted within a rotor housing 33, a pair of spiraled inlet channels 34, 36, and an exit air channel 38. As shown in FIG. 5, air enters the turbine through inlet slots 40 located on exterior walls of the first and second portions 12, 14 of the housing 10.

The brushroll 22 comprises a rotational axis 39 which is oriented approximately parallel to a longitudinal axis 41 of the turbine assembly 30. The brushroll 22 and the nozzle opening 24 are oriented approximately parallel to a longitudinal axis 43 of the housing 10. The orientation of the nozzle opening and brushroll allow the tool to be of a compact, narrow size which enables the tool to clean hard-to-reach areas such as room corners, the area between chair backs and seat cushions, etc.

Figure 6:
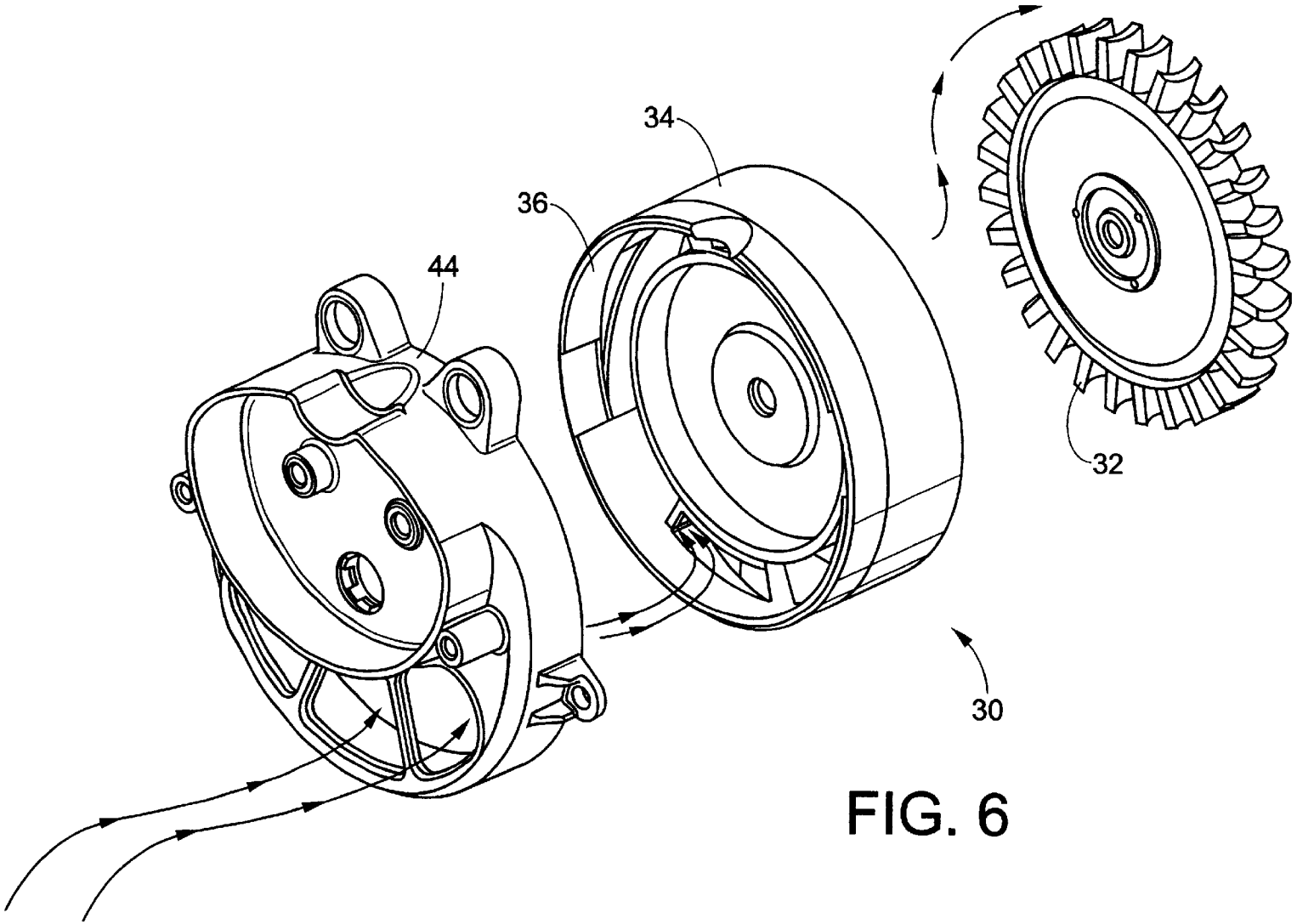
FIG. 6 is a perspective exploded view of the spiraled inlet channels, a turbine rotor and a gear train housing illustrating airflow therethrough; and, FIG. 7 is a perspective exploded view of a hose attachment and a locking swivel button for the turbo tool of FIG. 1.

As seen in FIG. 5, the air entering the turbine passes through a screen 42, preferably made of stainless steel, that is retained between a gear train housing 44 and a cover 46. As shown in FIG. 6, the air then proceeds to the spiraled air turbine inlet channels 34, 36 and to the turbine rotor 32. The spiraled inlet channels 34, 36 provide four air paths through two molded sections. Preferably, the two inlet channels 34, 36 are fabricated from thermoplastic material. The inlet channels 34, 36 comprise several staggered openings which provide the advantage of directing the air directly into the turbine. The air then passes through the rotor 32 to the exit channel 38 and into an exhaust tube 48 (see FIG. 3).

The turbine rotor 32 is rotated by the airflow. The turbine is drivingly connected to the brushroll 22 by a gear train 49 which is housed within the gear train housing 44. The gear train 49 comprises a series of gear reductions and belts which reduce the rotation of the brushroll 22 with respect to the turbine rotor 32. Thus, as the turbine rotor 32 rotates at a relatively higher rate of speed, the brushroll 22 is rotated at a relatively lower rate of speed, but with more power.

Figure 3:
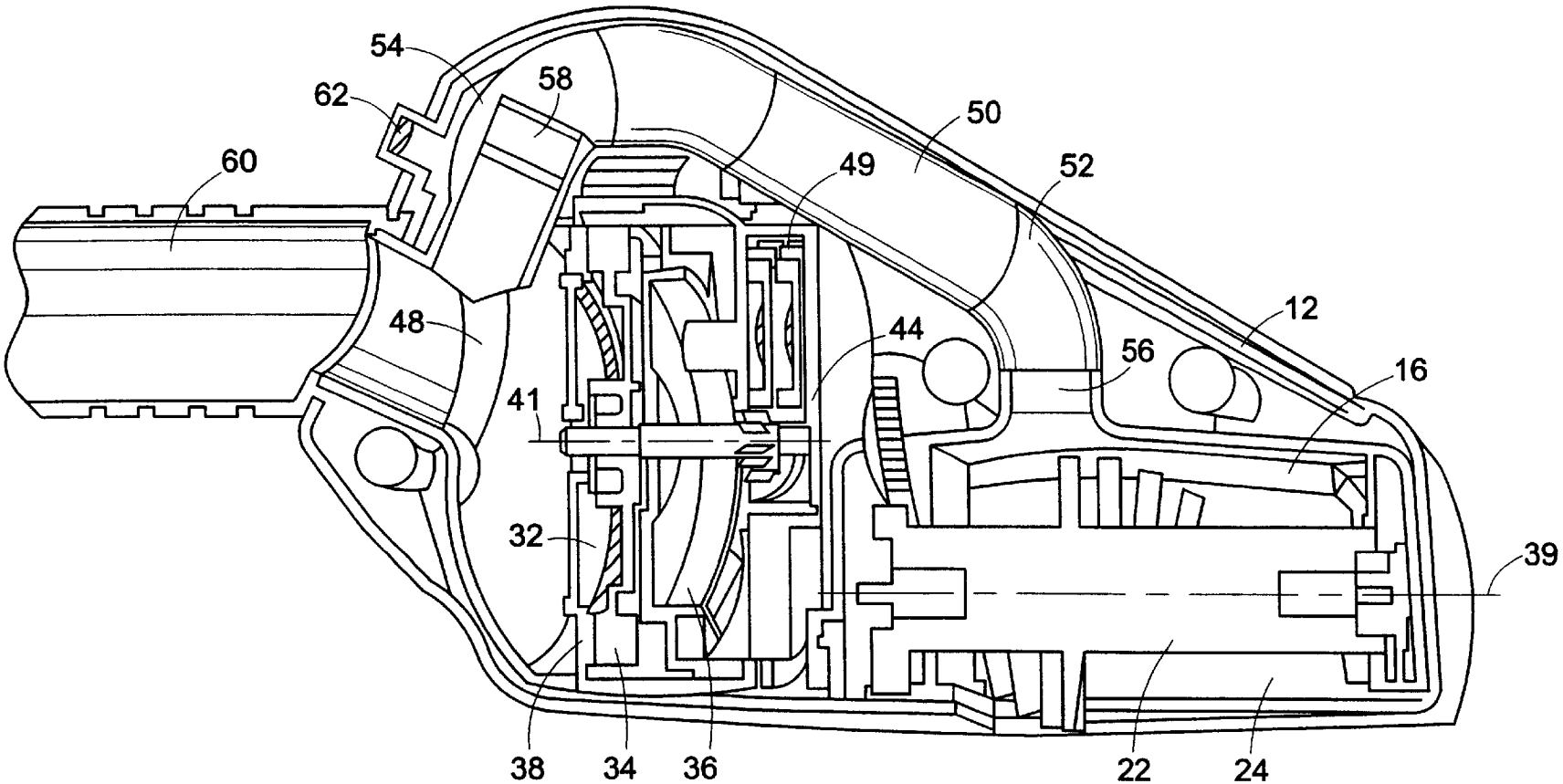
FIG. 3 is a side elevational view, in cross section, of the turbo tool of FIG. 1.

Referring to FIG. 3, a suction airflow flows through the brushroll housing opening 24. Dirty air and debris are sucked through the opening 24 and into a tube 50. The tube 50 has a first end 52 and a second end 54. The tube first end 52 is connected to an opening 56 located in the brushroll housing top section 18 above the brushroll 22. The hose second end 54 is connected to a tributary tube 58 which communicates with the exhaust tube 48. The two airflows, i.e., the airflow through the turbine and the airflow from the brushroll housing flow in parallel and merge at the exhaust tube 48. An advantage of this arrangement is that none of the dirt and debris that is pulled through the suction opening enters the turbine assembly. Thus, the turbine assembly is prevented from being damaged. The airflows are separated and merge beyond the rear of the turbine assembly. The combined airflows then pass through the exhaust tube 48 into a hose attachment 60. The hose attachment 60 is attached to a separate suction source, such as a vacuum cleaner (not shown).

Figure 7:
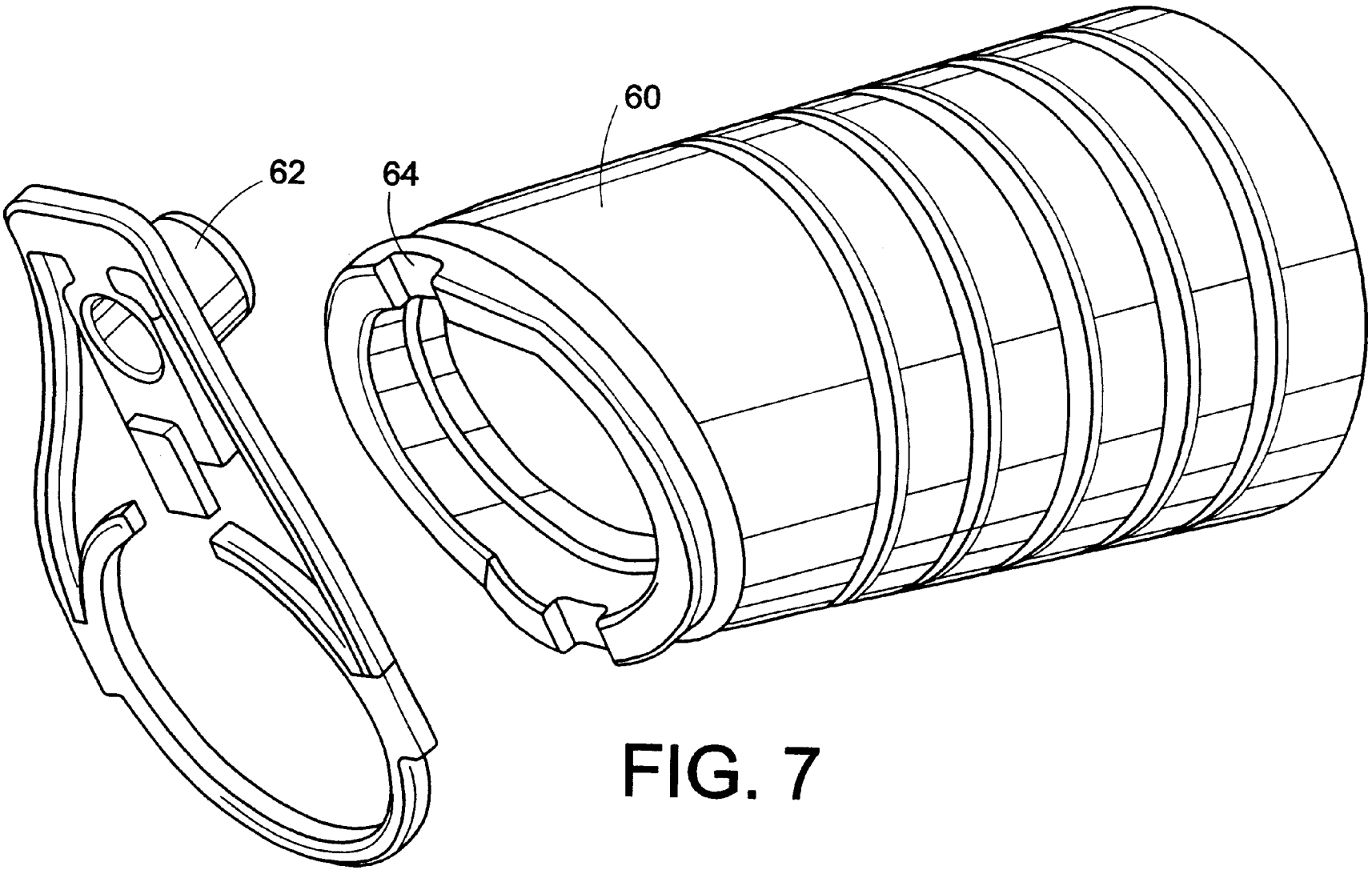

The exhaust tube 48 is connected to the hose attachment 60 which swivels or pivots approximately 180 degrees and locks into one of two positions. The tool can be used in one of two positions which are approximately 180 degrees apart. This allows for more versatile uses of the tool depending on which orientation of the tool is more convenient for the cleaning task at hand. Also, it allows the user to change the orientation of the tool head without twisting or tangling the hose. Referring to FIG. 7, the tool is unlocked by depressing a button 62 while rotating the tool. The button 62 locks the tool into position by engaging a notched area 64 on the swivel attachment 60. If desired, the button 62 may be made of an acetal material which acts as a spring when displaced. Thus, the button 62 does not require an additional spring when returning to its original position after being depressed.

Thus, one aspect of the present invention is the provision of a turbine powered brushing tool which has separate air passageways to a turbine and to a suction opening in a brushroll housing.

Another aspect of the present invention is the provision of a turbine powered tool including a spiraled air inlet channel to the turbine which provides directed airflow to the turbine without the need for additional parts.

Still another aspect of the present invention is the provision of a tool including a locking pivot which enables a user to pivot the tool between two positions approximately 180 degrees apart and lock the tool into position.

The invention has been described with reference to one embodiment. Obviously, modifications and alterations will occur to others upon a reading and understanding of this specification. It is intended to include all such modifications and alterations insofar as they come within the scope of the appended claims or the equivalents thereof.

What is claimed is:

1. A turbo tool comprising:

a housing forming a hollow section, said housing comprising at least one air inlet and a nozzle opening spaced from said at least one air inlet;

a brushroll rotatably mounted in said housing and within said nozzle opening;

a turbine mounted in said housing and drivingly connected to said brushroll for rotating said brushroll, said turbine being driven by a first airflow through said at least one air inlet in said housing, wherein a longitudinal axis of said brushroll is parallel to a longitudinal axis of said turbine; and a first conduit located in said housing and connected at a first end to said nozzle opening, wherein a second airflow occurs through said first conduit and wherein said first and second airflows occur at the same time.

2. The turbo tool of claim 1 wherein said brushroll is mounted parallel to a longitudinal axis of said housing.

3. The turbo tool of claim 1 wherein said nozzle opening is oriented parallel to a longitudinal axis of said turbine.

4. The turbo tool of claim 1 further comprising a second conduit being fluidly connected to said first conduit.

5. The turbo tool of claim 4 further comprising a third conduit fluidly connected to said second conduit.

6. The turbo tool of claim 5 wherein said third conduit is fluidly connected to an associated vacuum source.

7. The turbo tool of claim 6 further comprising a swivel attachment connected to said third conduit, wherein said swivel attachment allows said housing to swivel between two positions approximately 180 degrees apart.

8. The turbo tool of claim 7 further comprising a locking member which serves to lock said swivel attachment into one of said two positions and selectively allows the swivel attachment to rotate.

9. The turbo tool of claim 8 wherein said locking member is made of a resilient material which acts as a spring when displaced.

10. The turbo tool of claim 4, wherein said second airflow from said first conduit and said first airflow from said at least one air inlet merge into said second conduit.

11. The turbo tool of claim 1 further comprising a brushroll housing located within said nozzle opening, said brushroll housing enclosing said brushroll.

12. The turbo tool of claim 1 wherein said turbine comprises a rotor, a pair of spiraled inlet channels for directing airflow directly to said turbine, and an exit channel.

13. A turbo tool comprising:

a main housing forming a hollow section, said housing comprising at least one air inlet and a nozzle opening spaced from said at least one air inlet;

a brushroll housing located in said main housing and communicating with said nozzle opening;

a brushroll rotatably mounted in said brushroll housing;

a turbine mounted in said main housing and drivingly connected to said brushroll for rotating said brushroll, said turbine being driven by a first airflow through said at least one air inlet in said main housing, said at least one air inlet comprising at least one spiraled inlet channel for directing airflow directly to said turbine; and a first conduit located in said main housing and connected at a first end to said brushroll housing, wherein a second airflow occurs through said first conduit.

14. The turbo tool of claim 13 further comprising:

a second conduit held in said housing, said first conduit being fluidly connected at a second end to said second conduit; and a third conduit being fluidly connected to said second conduit.

15. The turbo tool of claim 14 further comprising a swivel attachment connected to said third conduit, wherein said swivel attachment allows said main housing to swivel between two positions approximately 180 degrees apart and can be locked into one of said two positions.

16. The turbo tool of claim 15, wherein said second airflow from said first conduit and said first airflow from said at least one air inlet merge into said second conduit.

17. The turbo tool of claim 13 wherein said brushroll is mounted parallel to a longitudinal axis of said brushroll housing.

18. The turbo tool of claim 13 wherein said turbine comprises a rotor, and an exit channel spaced from said motor.

19. A turbo tool comprising:

a housing forming a hollow section, said housing comprising at least one air inlet and a nozzle opening spaced from said at least one air inlet;

a brushroll rotatably mounted to said housing;

a turbine mounted in said housing and drivingly connected to said brushroll for rotating said brushroll, said turbine being driven by a first airflow through said at least one air inlet in said housing; and a swivel attachment connected to said housing, wherein said swivel attachment allows said housing to swivel between two positions approximately 180 degrees apart; said swivel attachment comprises a locking member made of a resilient material which acts as a spring when displaced.

20. The turbo tool of claim 19 wherein said brushroll is mounted parallel to a longitudinal axis of said housing.

21. The turbo tool of claim 19 wherein said brushroll is mounted on an axis parallel to a longitudinal axis of said turbine.

22. The turbo tool of claim 19 further comprising a first conduit located in said housing and connected at a first end to said nozzle opening, wherein a second airflow occurs through said first conduit.

23. The turbo tool of claim 22 further comprising a second conduit being fluidly connected to said first conduit.

24. The turbo tool of claim 23 further comprising a third conduit fluidly connected to said second conduit.

25. The turbo tool of claim 23, wherein said second airflow from said first conduit and said first airflow from said at least one air inlet merge into said second conduit.

26. The turbo tool of claim 19, wherein said turbine comprises a rotor and a pair of spiraled inlet channels adjacent said rotor for directing airflow directly to such rotor.

* * * * *